US005309930A

United States Patent [19]

Presser

[11] Patent Number: 5,309,930

[45] Date of Patent: May 10, 1994

[54] CURLER STEAMER

[75] Inventor: Mark Presser, New York, N.Y.

[73] Assignee: Celeste Company, Inc., Warminster, Pa.

[21] Appl. No.: 907,844

[22] Filed: Jul. 2, 1992

[51] Int. Cl.[5] ..... A45D 19/16

[52] U.S. Cl. ..... 132/272; 132/227; 261/142

[58] Field of Search ..... 132/227, 228, 229, 233, 132/272; 261/142, DIG. 65

[56] References Cited

U.S. PATENT DOCUMENTS

| | | | |
|---|---|---|---|
| 1,857,181 | 5/1932 | Collins | 261/DIG. 65 |
| 2,468,010 | 4/1949 | Duberstein | 261/DIG. 65 |
| 3,473,005 | 10/1969 | Grandinetti | 132/229 |
| 3,739,787 | 6/1973 | Keldmann et al. | 132/227 |
| 3,749,106 | 7/1973 | Kelmann et al. | 132/227 |
| 3,809,374 | 5/1974 | Schossow | 261/DIG. 65 |
| 3,990,441 | 11/1976 | Hoyt et al. | 261/DIG. 65 |
| 4,009,713 | 3/1977 | Simmons et al. | 261/DIG. 65 |
| 4,225,542 | 9/1980 | Wall et al. | 261/142 |
| 4,463,248 | 7/1984 | Katzman et al. | 261/142 |
| 4,771,797 | 9/1988 | Kosaka | 132/272 |

FOREIGN PATENT DOCUMENTS

| | | | |
|---|---|---|---|
| 3943572 | 6/1991 | Fed. Rep. of Germany | 132/228 |

*Primary Examiner*—Gene Mancene
*Assistant Examiner*—Frank A. LaViola
*Attorney, Agent, or Firm*—Woodcock Washburn Kurtz Mackiewicz & Norris

[57] ABSTRACT

A steamer for steaming hair curlers comprises an oblong tank having an open top which is closed by a lid. A pair of latches are captured for slight movement on opposite sides of the lid and engaged under steps defined on opposite sides of the tank. The lid carries a pair of depending electrodes which are protected within a perforated enclosure fixed to the lid. A power cord is connected between the electrodes for applying electrical energy to the electrodes which generates steam when the electrodes are emersed in an electrolyte in the tank.

7 Claims, 5 Drawing Sheets

CURLER STEAMER

FIELD AND BACKGROUND OF THE INVENTION

The present invention relates in general to steamers utilizing two electrically powered electrodes which are emersed into an electrolyte, in particular, salt water, and which thereby generate steam. In particular, the invention relates to a steamer used specifically for impregnating a hair curler with steam.

U S. Pat. Nos. 3,759,271 and 4,453,554 both to Caruso, disclose curlers including cores surrounded by foam rubber sleeves which are adapted for receiving steam to heat and moisturize the curlers in preparation for curling hair.

A commercial product marketed by Celeste Company, Inc. and incorporating the Caruso inventions, includes a steamer comprising a cylindrical tank having a top covering which carries a pair of electrodes that are emersed into the tank. All electrical connections are made to the top so that steam generation is instantaneously stopped when the top is removed from the tank.

No mechanism is provided for firmly fixing the top to the tank so that a constant danger of spilling exists.

SUMMARY OF THE INVENTION

The steamer of the present invention is an improvement over the prior art in that it includes latches that positively lock the steamer cover to the steamer tank. The latches require no metal parts and are extremely simple in construction and function while still being highly effective in securing the steamer parts to each other. The lack of metal is important in view of the salt water used with the steam which would tend to corrode metal parts. Further the latches are easily disconnected for refilling the tank or when the top of the steamer is to be removed for stopping the generation of steam.

Accordingly an object of the present invention is to provide a curler steamer which comprises: a tank having a side wall, a bottom wall and an open top, the side wall having at least one latch capturing step; a tank closure assembly having a lid portion shaped to close said open top, and electrode means depending from said lid portion for extending into the tank to generate steam when the tank contains an electrolyte and when electrical power is applied to the electrode means, the lid portion including a steam aperture for discharging steam generated in the tank; and at least one latch captured by said tank closure assembly for limited movement, said latch having a hook for engagement with said step when said lid portion closes said open top, and for detachable fixing said assembly to said tank, said latch being moveable only to an extent to allow said hook to disengage from said step for removing the assembly from the tank.

A further object of the invention is to provide a curler steamer, in particular, a curler steamer with a latch structure, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
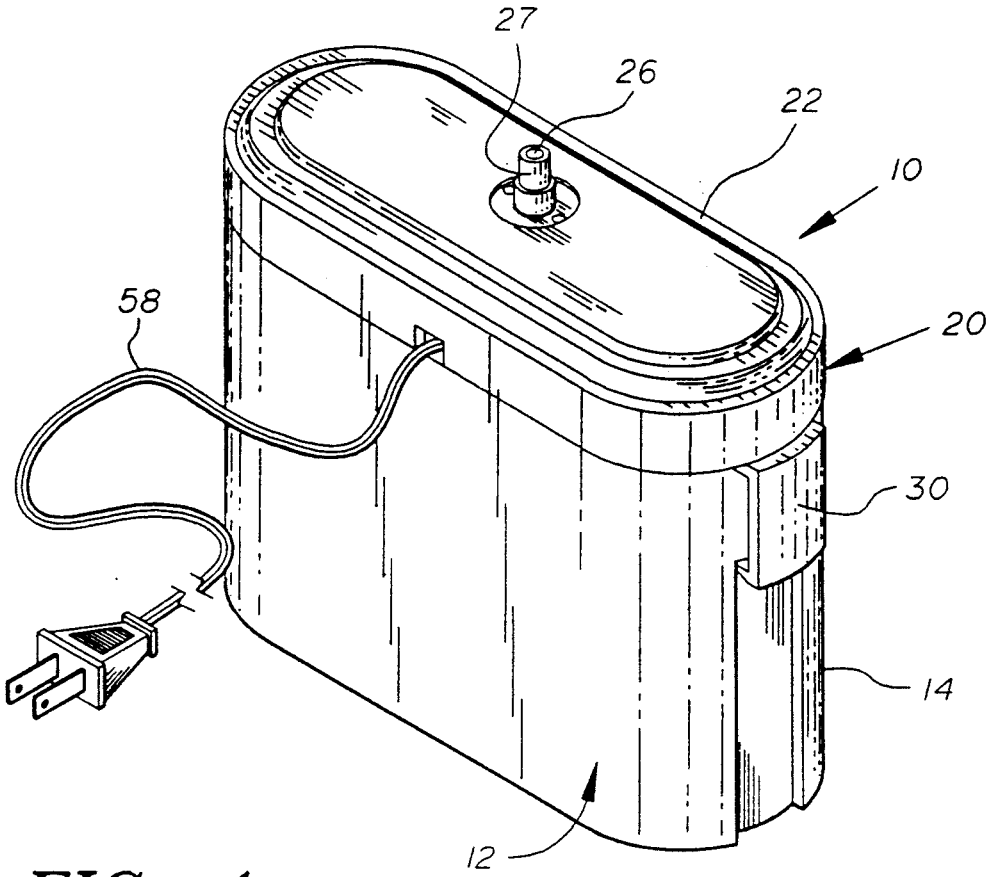
FIG. 1 is a side top perspective view of a steamer curler according to the present invention.
Figure 5:
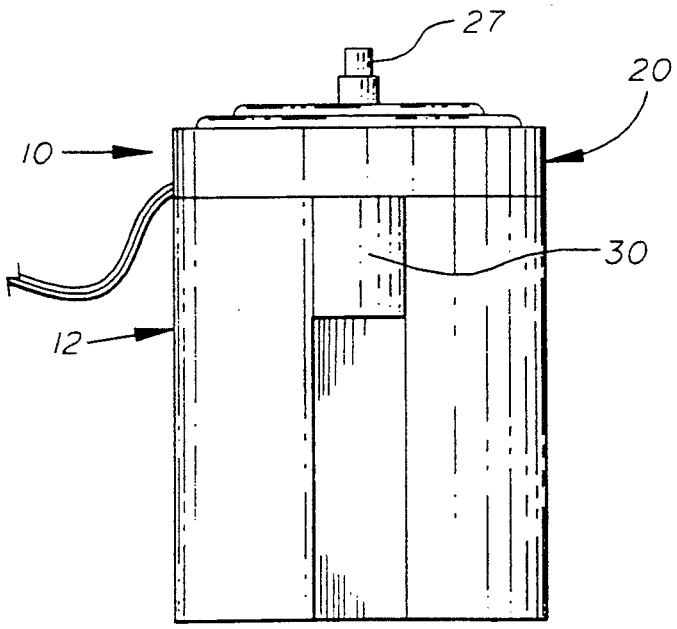
FIG. 5 is a side elevational view thereof.
Figure 2:
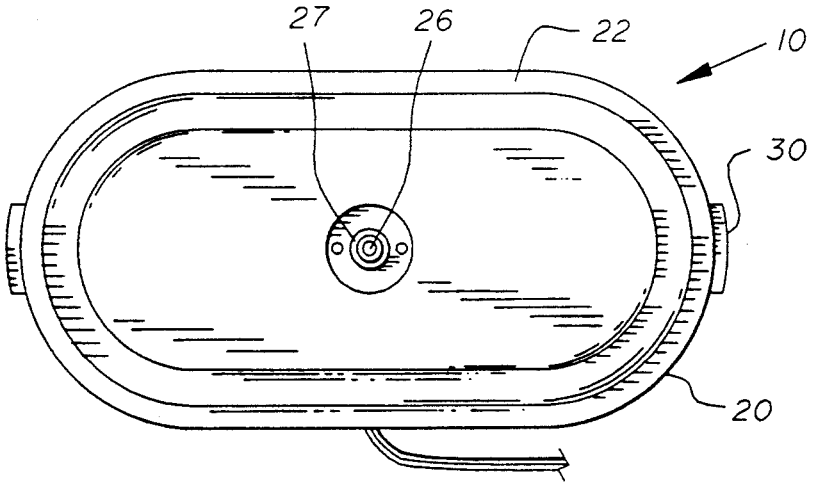
FIG. 2 is a top plan view thereof.
Figure 3:
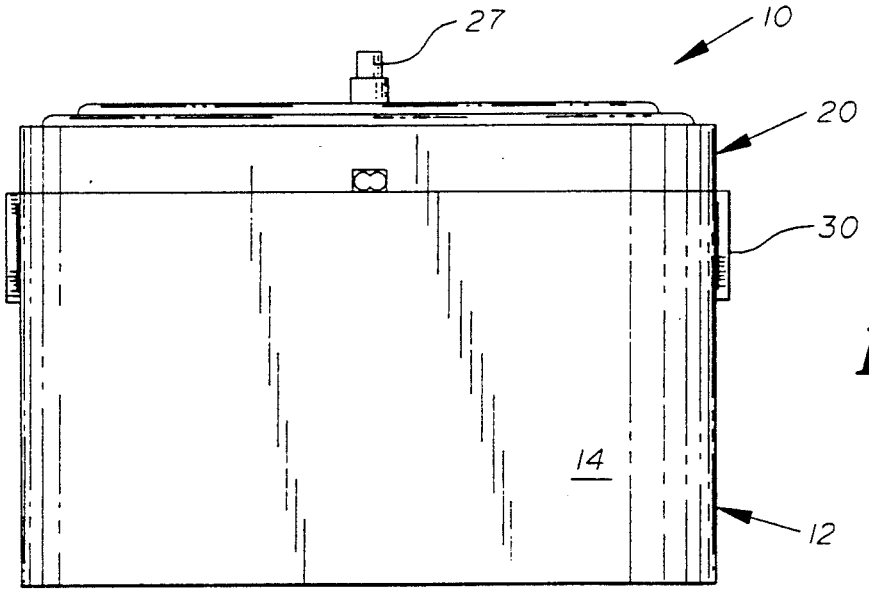
FIG. 3 is a side elevational view.
Figure 4:
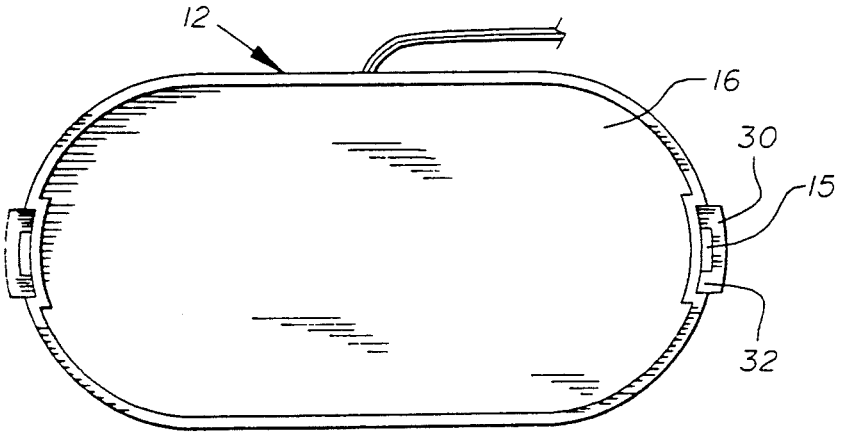
FIG. 4 is a bottom plan view thereof.

Referring to the drawings in particular, the invention embodied in FIGS. 1–5 comprises a curler steamer generally designated 10 having a tank 12 with an oval side wall 14, a bottom 16 which is closed and an open top 18 (FIG. 6) which, in use, is closed by a tank closure assembly 20.

Assembly 20 is detachable fixed to tank 12 by a pair of latches 13 which are captured to the assembly for limited movement and which each include a pair of hooks 32 for engaging under a latch capturing step 15 on opposite sides of the oblong tank 12.

A central aperture 26 through the closure assembly is provided in a cylindrical steam post 27 for receiving a steam inlet of a steam heatable hair curler (not shown).

Figure 6:
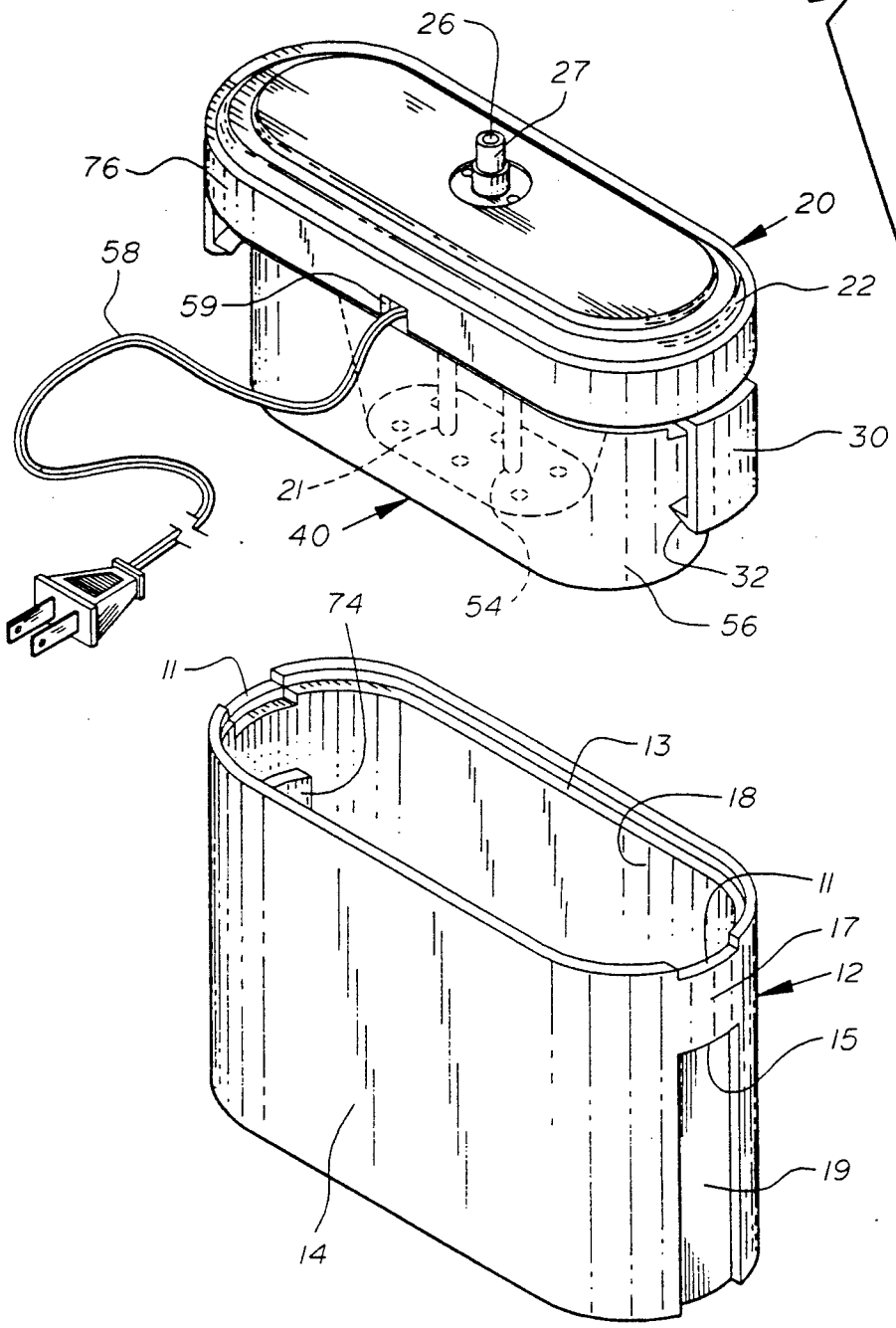
FIG. 6 is an exploded perspective view illustrating the tank and closure assembly of the present invention.
Figure 7:
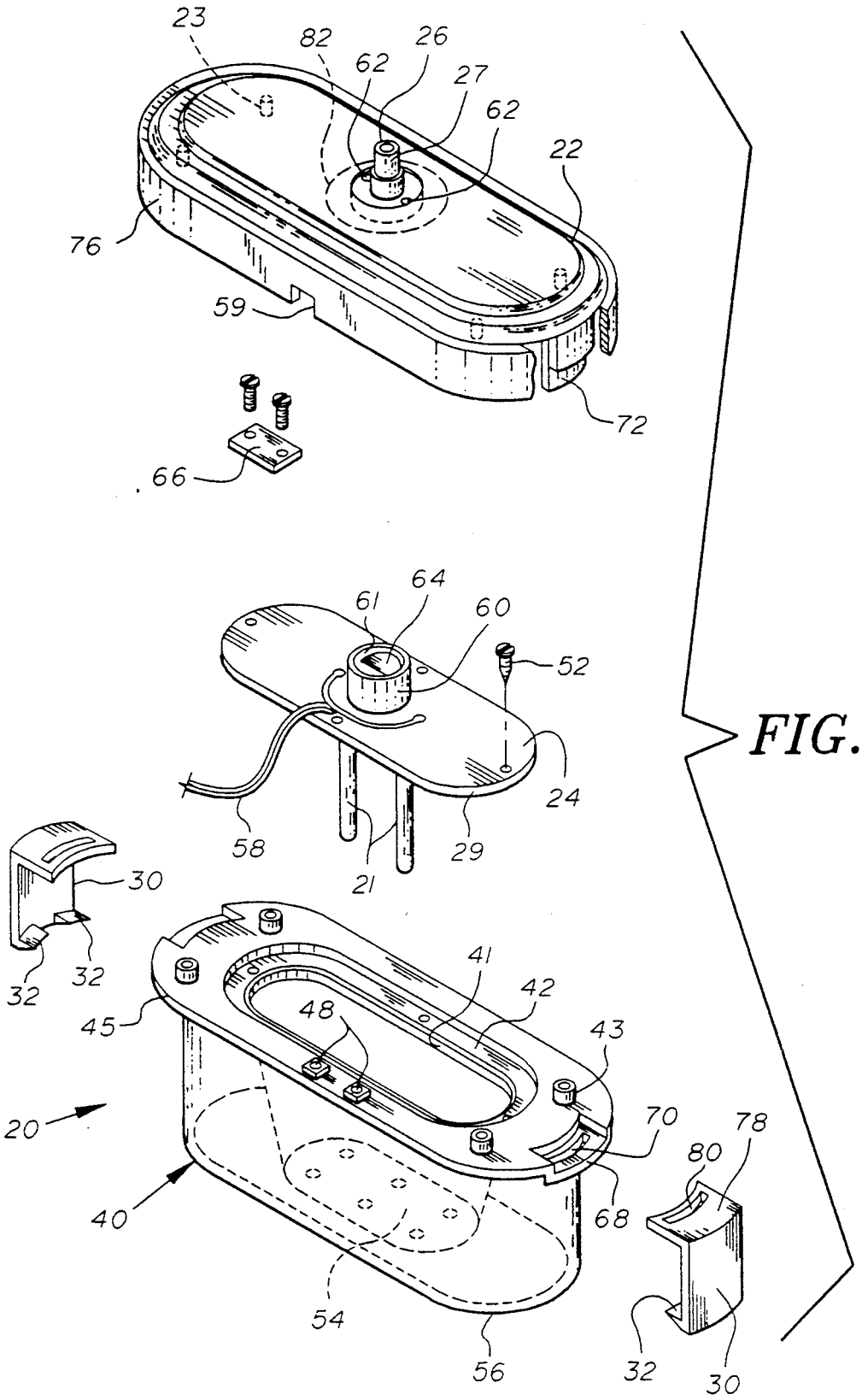
FIG. 7 is an exploded perspective view illustrating the tank closure assembly.

As best shown in FIG. 6 and 7, assembly 20 includes a lid portion 22 which is shaped to close the open top 18 of the oblong tank 12.

Lid portion 22 is fixed to a cage 40 which carries an electrode set 24. Raised and hollow cylindrical posts 43 each receive one of four cylindrical pins 23 extending downwardly from the inside of lid portion 22, and are either glued or otherwise fixed for permanently holding the lid to the cage. Before this is done the electrode set 24 which comprises an insulated wafer 29 from which two carbon electrodes 21 depend, is seated on a ledge 41 and over a gasket 42, and fixed to the cage 40 by screws, e.g., screw 52. Carbon electrodes 21 extend down into an inner perforated enclosure 54 which is surrounded by an oval outer skirt 56 which is downwardly open for free access between the electrolyte in the tank and the electrodes.

When electrical power, for example 110 volts AC, is applied to an electrical line 58 that has two conductors that are connected to the respective electrodes 21, steam is generated from the electrolyte in a known fashion. The steam rises within the enclosure 54 and moves through a cylindrical projection 60 which extends up to the vicinity below aperture 26, to discharge steam from inside the tank, through the aperture 26.

Secondary holes or apertures 62 also communicate with the interior of cylinders 60 for providing a secondary supply of steam. Steam flow is somewhat retarded by a cross member 64 which extends across the interior of cylinder 60 and below the inner ends of apertures 26 and 62.

A cylindrical rim 82 extends downwardly from the underside of lid portion 22 and is sized to closely engage around the cylinder 60 to form an efficient seal between the interior of the tank and the apertures 26, 62. To improve this seal further, a gasket 61 is provided on the upper rim of cylinder 60 for pressing up against the undersurface of lid 22 around apertures 26, 62.

Cage 40 further comprises a flange 45 which carries the connector posts 43 and which also has a pair of projections 48 between which the electrical power line 58 extends. An insulated material plate 66 held down by a pair of screws threaded into projections 48, holds the power line in place. A notch 59 in skirt 76 of lid 22 allows line 58 to pass out of the assembly.

Flange 45 is oblong and conforms in shape to the interior of tank top opening 18. The flange is also shaped to closely sit on a ledge 13 defined within the tank. The flange 45 includes opposite depressions 68 which each contain a slot 70 shaped to receive a depending tab 72 extending downwardly from the interior of lid portion 22. Depression 68 is received within a correspondingly shaped depression within the ledge 13 adjacent a recess 11 in the top rim of the tank opening, positioned above the step 15 and defining a land 17 between the step 15 and the recess 11. A longitudinally extending groove 19 is provided below step 15 both for aesthetic and functional reasons. Internally, step 15 and groove 19 project into tank 18 at an enlargement 74.

The side skirt 76 of lid portion 22 is shaped to engage over the upper rim of tank 12 and capture an upper leg 78 of each latch 30 in a respective depression 68. A slot 80 is provided in each leg 78 for receiving the tab 72. Slot 80 is selected to be slightly larger than tab 72 so that latch 30 is captured yet can move slightly on the depression 68. This movement is selected to allow hooks 32 on each latch 30 to just clear the steps 15 and slide along lands 17 for engagement and disengagement of the closure assembly to the tank. The distance between leg 78 and hooks 32 on each latch is also selected to be approximately the same as the vertical height of land 17 so that leg 78 firmly sits within recess 11 and hooks 32 firmly engage step 15, to produce a firm clip-like latch, yet be removable for fixing and removing closure assembly to the tank.

Figure 8:
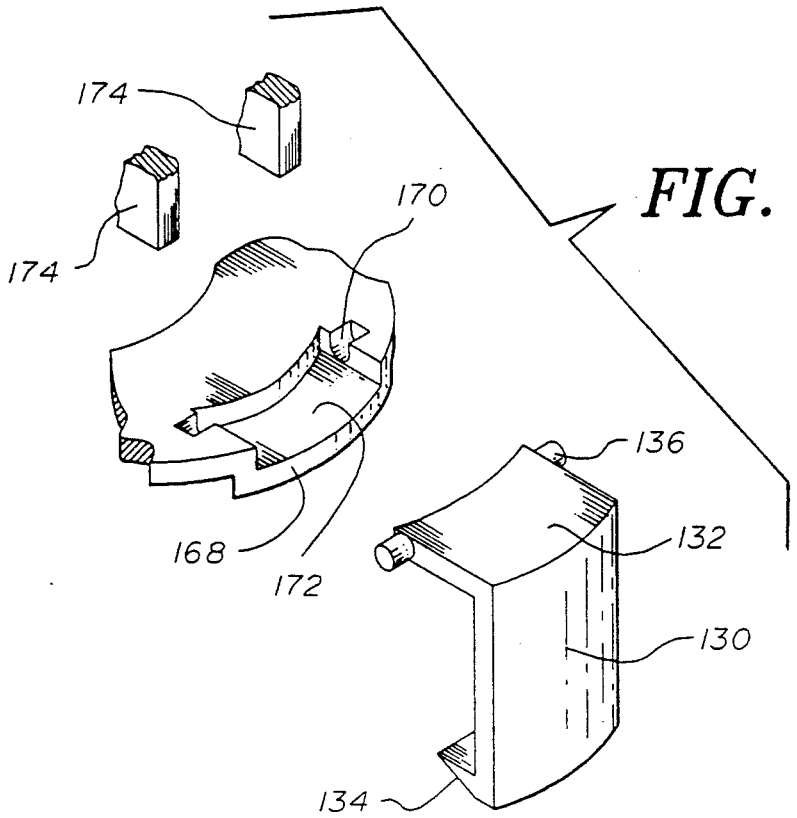
FIG. 8 is a fragmentary view showing an alternate tank closure assembly.

Referring to FIG. 8, an alternate closure assembly uses a latch 130 similar in most respects to the latch 30 of FIG. 7 except that latch 130 includes an upper leg 132 having a pair of outwardly extending trunnions 136 which are shaped to be rotatably received within a pair of recesses 170 on opposite sides of a main recess 172 in the upper flange of the cage. Trunnions 136 rather than being cylindrical, are slightly oval or flattened in the horizontal extent, to favor an upright latched position for latch 130. To keep trunnions 136 in the recesses 170, retaining plates 174, provided in the cover are positioned over the recesses when the cover is assembled with the cage.

Figure 9:
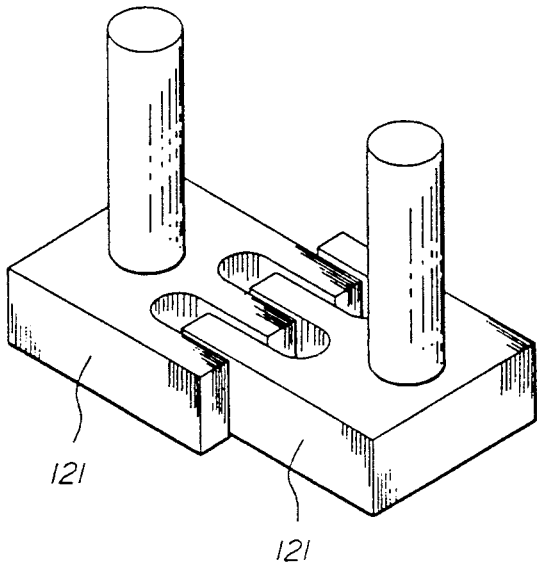
FIG. 9 is a schematic perspective view of comb electrodes for use with the invention.

Referring to FIG. 9, an alternate version of the electrodes shown at 21 in FIG. 1 are shown at 121. These electrodes are each comb like and maximize a facing distance therebetween to minimize or completely eliminate completely the need for salt in tap water used with the invention. Whatever minor impurities are in the tap water are enough to produce steam using the comb electrodes. For the purpose of this application, the term "electrolyte" is to include tap water and the limited impurities in tap water which can be used with the present invention to create steam.

While a specific embodiment of the invention has been shown and described in detail to illustrate the application of the principles of the invention, it will be understood that the invention may be embodied otherwise without departing from such principles.

What is claimed is:

1. A curler steamer which comprises:

a tank having a side wall, a bottom wall and an open top, the side wall having at least one latch capturing step;

a tank closure assembly having a lid portion shaped to close said open top, and electrode means depending from said lid portion for extending into the tank to generate steam when the tank contains an electrolyte and when electrical power is applied to the electrode means, the lid portion including a steam aperture for discharging steam generated in the tank;

and at least one latch captured by said tank closure assembly for limited movement, said latch having a hook for engagement with said step when said lid portion closes said open top, and for detachable fixing said assembly to said tank, said latch being moveable only to an extent to allow said hook to disengage from said step for removing the assembly from the tank;

said closure assembly including means defining a depression, said latch including a leg, said leg being positioned in said depression, said lid portion including a retaining member over said depression and capturing said latch leg for limited movement of said latch to said closure assembly;

said tank including a recess at its open top, for receiving said latch leg, said recess being spaced from said step by distance which is substantially equal to a distance between said leg and said hook on said latch;

said depression including a recess, said leg having a trunnion extending into said recess.

2. A curler steamer which comprises:

a tank having a side wall, a bottom wall and an open top, the side wall having at least one latch capturing step;

a tank closure assembly having a lid portion shaped to close said open top, and electrode means depending from said lid portion for extending into the tank to generate steam when the tank contains an electrolyte and when electrical power is applied to the electrode means, the lid portion including a steam aperture for discharging steam generated in the tank;

and at least one latch captured by said tank closure assembly for limited movement, said latch having a hook for engagement with said step when said lid portion closes said open top, and for detachable fixing said assembly to said tank, said latch being moveable only to an extent to allow said hook to disengage from said step for removing the assembly from the tank;

said tank closure assembly including a cage fixed to said lid portion, said cage including an upper opening and a perforated enclosure extending downwardly from said upper opening, said electrode means comprising an insulated wafer, a pair of electrodes fixed to said insulated wafer, an electric power line connected to said pair of electrodes, said wafer being fixed over said upper opening of said cage with said electrodes depending into said perforated enclosure;

said cage including a flange shaped to be received closely within the open top of said tank, a depression in said flange, said latch including a leg engaged in said depression and means for capturing said leg between said lid and said cage in said depression for limited movement of said latch.

3. A curler steamer according to claim 2, wherein said means for capturing said latch comprises a slot in said latch leg and a tab extending downwardly from said lid portion and extending into said slot.

4. A curler steamer according to claim 3, wherein said tank includes a recess adjacent said open top, shaped for receiving said latch leg, and a space between said latch leg and said latch hook being equal to a distance between said recess and said step.

5. A curler steamer which comprises:

a tank having a side wall, a bottom wall and an open top, the side wall having at least one latch capturing step;

a tank closure assembly having a lid portion shaped to close said open top, and electrode means depending from said lid portion for extending into the tank to generate steam when the tank contains an electrolyte and when electrical power is applied to the electrode means, the lid portion including a steam aperture for discharging steam generated in the tank;

and at least one latch captured by said tank closure assembly for limited movement, said latch having a hook for engagement with said step when said lid portion closes said open top, and for detachable fixing said assembly to said tank, said latch being moveable only to an extent to allow said hook to disengage from said step for removing the said tank being oblong and including a latch capturing step on opposite short sides thereof, said steamer including a latch captured on opposite sides of said assembly, each for engaging one of said steps;

said closure assembly including means defining a depression containing a recess, said leg having a trunnion and being positioned in said depression, said lid portion including a retainer extending over said recess and capturing said latch leg trunnion for limited movement of said latch to said closure assembly.

6. A curler steamer according to claim 5, wherein said tank includes a recess for receiving said latch leg, said tank recess being spaced from said step by a distance which is substantially equal to a distance between said leg and said hook on said latch.

7. A curler steamer according to claim 6, wherein said leg of said latch includes a second trunnion extending into a second recess in said depression.

* * * * *